US008414075B2

(12) United States Patent
Ko

(10) Patent No.: US 8,414,075 B2
(45) Date of Patent: Apr. 9, 2013

(54) CHAIR ADJUSTMENT STRUCTURE

(76) Inventor: Wen-Shan Ko, Changhua County (TW)

( * ) Notice: Subject to any disclaimer, the term of this patent is extended or adjusted under 35 U.S.C. 154(b) by 295 days.

(21) Appl. No.: 12/876,693

(22) Filed: Sep. 7, 2010

(65) Prior Publication Data

US 2011/0291452 A1 Dec. 1, 2011

(51) Int. Cl.
*A47C 1/00* (2006.01)
*A47C 1/024* (2006.01)

(52) U.S. Cl.
USPC ..... 297/340; 297/302.4; 297/302.5; 297/302.6

(58) Field of Classification Search ..... 297/285, 297/301.4, 301.5, 301.6, 302.4, 302.5, 302.6, 297/303.4, 339, 340
See application file for complete search history.

(56) References Cited

U.S. PATENT DOCUMENTS

| | | | | |
|---|---|---|---|---|
| 2,859,801 | A * | 11/1958 | Moore | 297/322 |
| 5,658,045 | A * | 8/1997 | Van Koolwijk et al. | 297/300.5 |
| 5,775,774 | A * | 7/1998 | Okano | 297/300.2 |
| 6,120,096 | A * | 9/2000 | Miotto | 297/301.4 |
| 6,588,843 | B1 * | 7/2003 | Ebenstein | 297/300.1 |
| 6,722,741 | B2 * | 4/2004 | Stumpf et al. | 297/452.3 |
| 6,957,862 | B2 * | 10/2005 | Chen | 297/300.1 |
| 7,097,249 | B2 * | 8/2006 | Igarashi et al. | 297/323 |
| 7,278,685 | B1 * | 10/2007 | Lin | 297/301.7 |
| 7,281,764 | B2 * | 10/2007 | Thole | 297/303.4 |
| 2006/0006715 | A1 * | 1/2006 | Chadwick et al. | 297/300.4 |
| 2008/0054700 | A1 * | 3/2008 | Meidan | 297/361.1 |
| 2010/0084904 | A1 * | 4/2010 | Erker | 297/340 |

* cited by examiner

*Primary Examiner* — David Dunn
*Assistant Examiner* — Philip Gabler
(74) *Attorney, Agent, or Firm* — Browdy and Meimark, PLLC

(57) ABSTRACT

A chair adjustment structure includes a base member, a top cover pivotally connected to the base member, a spring member connected between the base member and the top cover, and a back bracket pivotally connected to the base member and the top cover. Therefore, when the user sits on the seat pad of the chair, the back bracket is forced to pivot the top cover to provide the user with sitting comfort.

7 Claims, 10 Drawing Sheets

CHAIR ADJUSTMENT STRUCTURE

BACKGROUND OF THE INVENTION

1. Field of the Invention

The present invention relates to chairs and more particularly, to a chair adjustment structure.

2. Description of the Related Art

For regular high-back chairs, the angle between the seat back and the seat pad cannot be automatically changed when the user rests his (her) back one the seat back. Thus, the user tends to feel uncomfortable after sitting on it for a long time. To eliminate this drawback, ergonomic chairs were created, allowing adjustment of the angle of inclination of the seat back to meet the user's need for sitting comfort.

However, when the user sits on the seat pad of a high-back chair, the user must move the hip backwards so that the user's back can be rested on the seat back of the chair. When the angle of inclination of the seat back is changed subject to the pressure from the user's back, the user's legs may become suspended in the air above the floor. The user will feel uncomfortable after sitting for a long time with this sitting posture. Further, when the user is going to leave from the chair, the chair does not provide any auxiliary push force for the user to help the user leave from the chair. Therefore, the user must apply a great force to the floor with the feet to leave from the seat of the chair.

SUMMARY OF THE INVENTION

The present invention has been accomplished under the circumstances in view. It is the main object of the present invention to provide a chair adjustment structure, which enables the chair to provide sitting comfort for the user.

It is another object of the present invention to provide a chair adjustment structure, which allows the user to leave from the chair with less effort.

To achieve the foregoing objects of the present invention, a chair adjustment structure comprises a base member, a top cover, a spring member and a back bracket. The top cover is located at the top side relative to the base member, having a middle part thereof pivotally connected to the base member. The spring member is mounted in the base member, having the top end thereof stopped against the top cover. The back bracket comprises two sidewalls. Each sidewall has a first extension portion disposed at one lateral side of the base member, a second extension portion obliquely upwardly extending from the first extension portion, a first pivot portion located on one end of the first extension portion and pivotally connected to the base member and a second pivot portion located on the first extension portion adjacent to the second extension portion and pivotally connected to the top cover.

The chair adjustment structure further comprises a seat frame assembly pivotally connected to the top cover for mounting a seat pad, to provide a return force to the mounted seat pad.

The chair adjustment structure further comprises an angle adjustment device set. The angle adjustment device set comprises a locating plate movably forwards and backwards mounted to the base member and selectively engageable into one of a plurality of locating grooves at the top cover to adjust the angle of inclination of the seat frame assembly.

The chair adjustment structure further comprises a spring adjustment device set. The spring force adjustment device set comprises a knob rotatably mounted in the base member and having a screw rod extending from one side thereof and inserted through the spring member, and a screw nut threaded onto the screw rod of the knob and stopped against the bottom end of the spring member and rotatable to adjust the spring force of the spring member to the top cover.

When the back bracket is biased by an external force, the back bracket forces the top cover to incline upwardly through a small angle subject to the linking arrangement between the top cover and the back bracket. Therefore, the user will not suspend the feet in the air above the ground after having sat in position, and the chair installed with the chair adjustment structure can provide sitting comfort for the user.

DETAILED DESCRIPTION OF THE INVENTION

Figure 1:
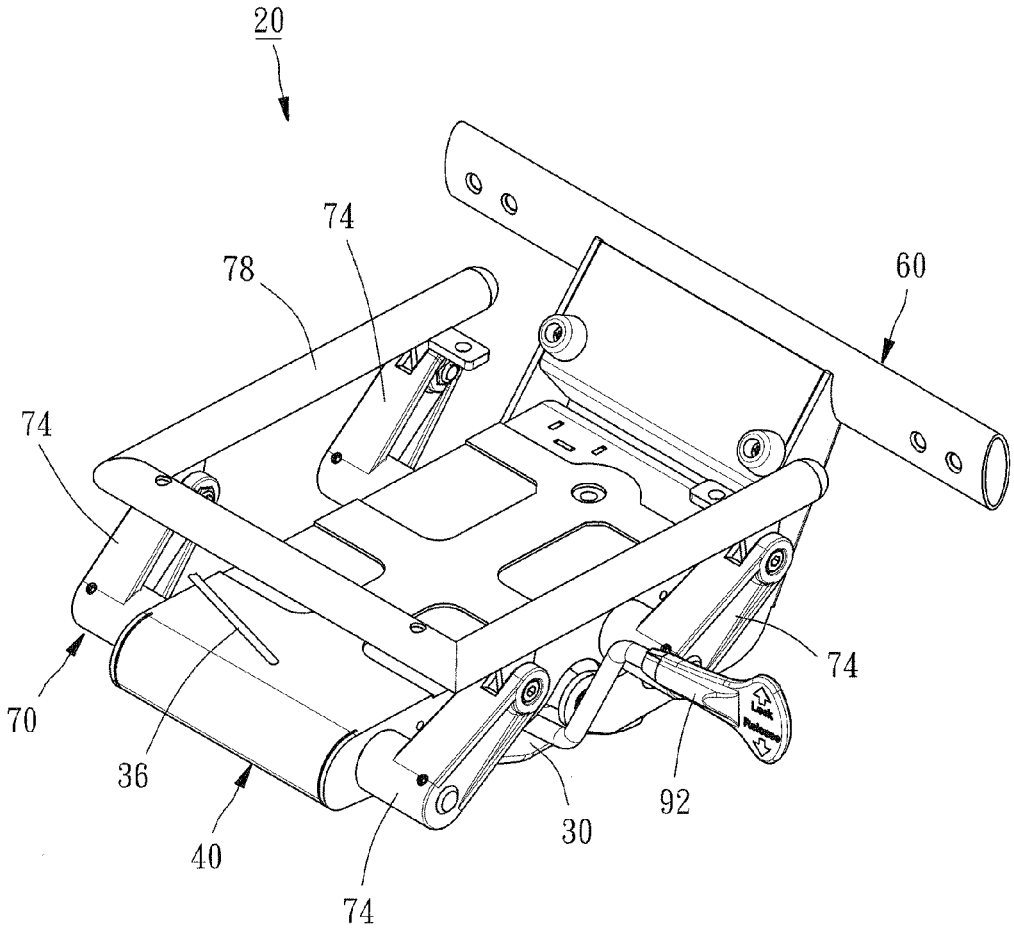
FIG. 1 is an elevational view of a chair adjustment structure in accordance with the present invention.

Referring to FIGS. 1-3 and FIG. 8, a chair adjustment structure 20 in accordance with the present invention is composed of a base member 30, a top cover 40, a spring member 50, a back bracket 60, a seat frame assembly 70, a spring force adjustment device set 80, and an angle adjustment device set 90.

Figure 3:
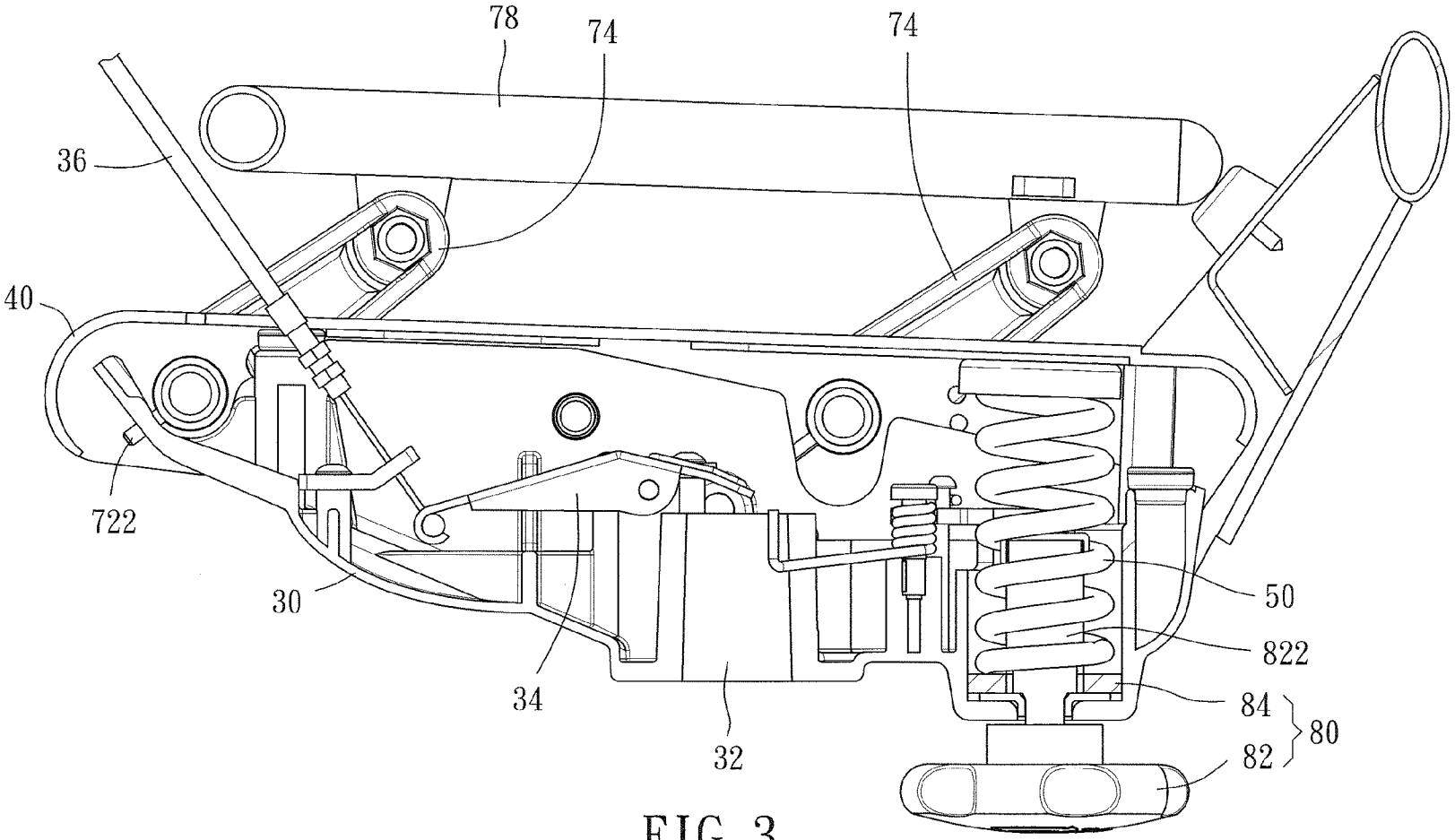
FIG. 3 is a sectional view, in an enlarged scale, of the chair adjustment structure in accordance with the present invention.
Figure 5:
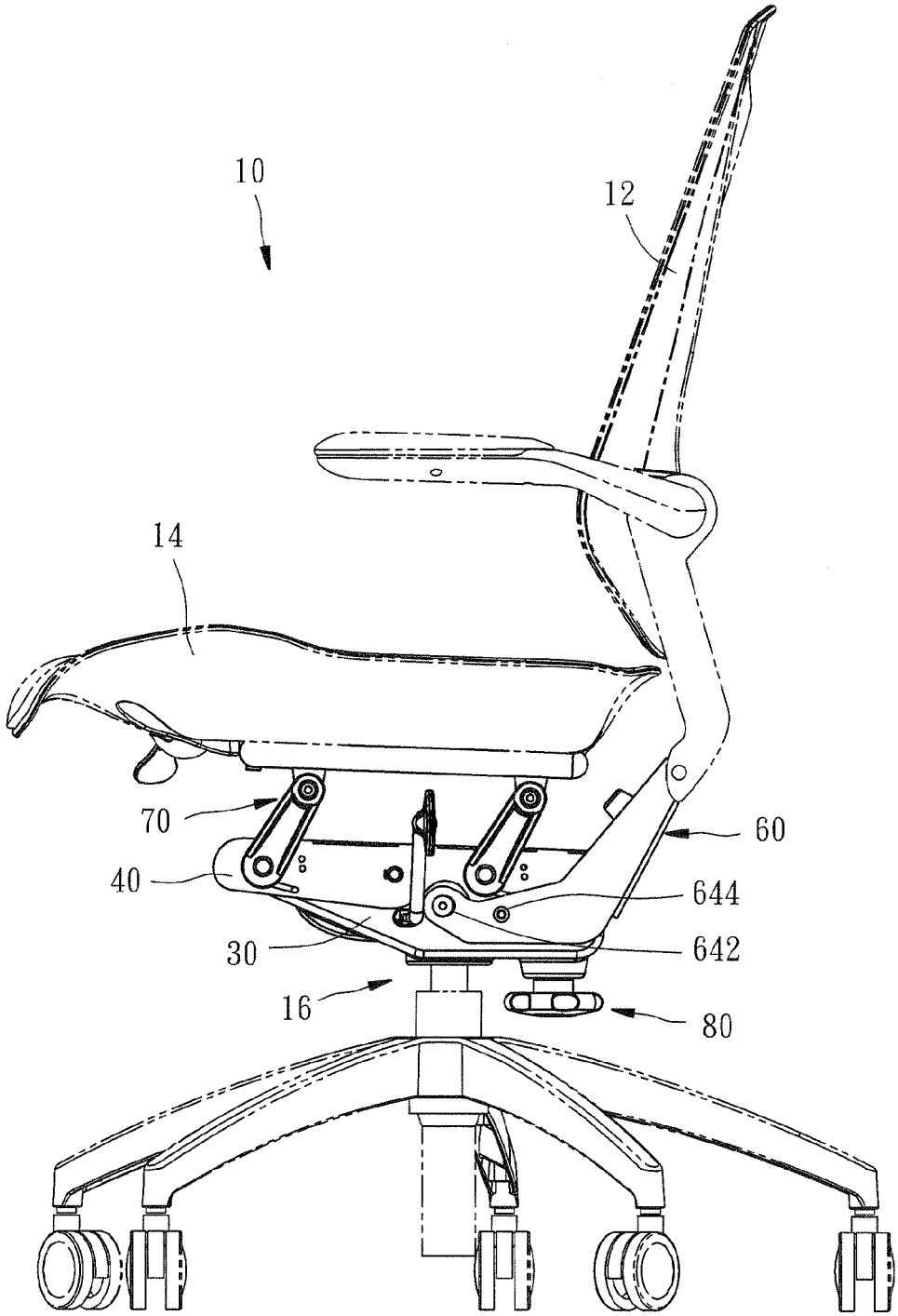
FIG. 5 is a side view of the present invention, showing the chair adjustment structure applied to a chair.

The base member 30 has a pneumatic lifter mounting hole 32 for a pneumatic cylinder 16 of a chair 10 to pass through, as shown in FIG. 3 and FIG. 5. An actuating member 34 is pivotally connected to the base member 30, having one end thereof projecting into a top end of the pneumatic lifter mounting hole 32 and the other end thereof connected to a cord member 36, as shown in FIG. 3. Thus, the actuating member 34 can be biased by the cord member 36 to pivot and press the pneumatic lifter 16, thereby adjusting the elevation of the chair 10.

Figure 4:
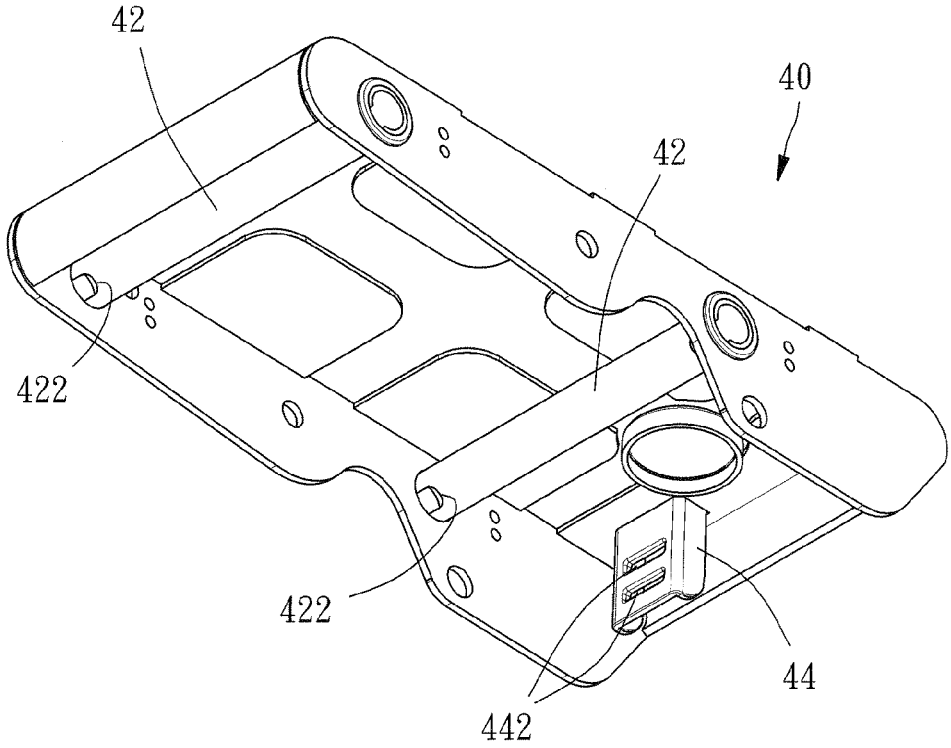
FIG. 4 is an oblique bottom view of the top cover of the chair adjustment structure in accordance with the present invention.

The top cover 40 has its middle part pivotally connected to the base member 30 and is located on the top side of the base member 30, having two bottom barrels 42 and a bottom positioning member 44, as shown in FIG. 4. Each barrel 42 has a notch 422 located at each of the two distal ends thereof. The positioning member 44 has two locating grooves 442.

The spring member 50 is mounted in the base member 30 and stopped with its top end against the top cover 40 to provide a return force for the top cover 40 while the top cover 40 is pressed, as shown in FIG. 3.

The back bracket 60 is adapted to hold the seat back 12 of the chair 10, as shown in FIG. 5, having two sidewalls 62. Each sidewall 62 has a first extension portion 64 disposed at one lateral side of the base member 30, a second extension portion 66 obliquely upwardly extending from the first extension portion 64, a first pivot portion 642 located on one end of the first extension portion 64 and pivotally connected to the base member 30, and a second pivot portion 644 located on the first extension portion 64 adjacent to the second extension portion 66 and pivotally connected to the top cover 40.

The seat frame assembly 70 comprises two axles 72, four links 74, four torsion springs 76, and a seat frame 78. The axles 72 are respectively pivotally inserted through the barrels 42 of the top cover 40, each having a pin 722 radially extending from one of the two distal ends thereof and respectively inserted through the notch 422 to the outside for stopping against the wall of the associating notch 422 to limit the angle of rotation of the axles 72 relative to the barrels 42. A bottom end of each of the links 74 is pivotally connected with one end of one of the axle 72. The torsion springs 76 are respectively mounted to the two distal ends of each of the two axles 72 with the opposite ends thereof respectively stopped against the top cover 40 and the links 74 to provide a torsional force for the links 74 for returning the links 74 to their former position while the links 74 are biased. The seat frame 78 is pivotally connected to top ends of the links 74 for holding a seat pad 14 of the chair 10.

The spring force adjustment device set 80 comprises a knob 82 and a screw nut 84. As shown in FIG. 3, the knob 82 is rotatably mounted to the base member 30, having a screw rod 822 inserted through the spring member 50. The screw nut 84 is threaded onto the screw rod 822 of the knob 82 and stopped against a bottom end of the spring member 50. When the knob 82 is rotated, the screw nut 84 can be driven by the screw rod 822 to compress the spring member 50, thus changing the spring force applied to the top cover 40 from the spring member 50.

Figure 2:
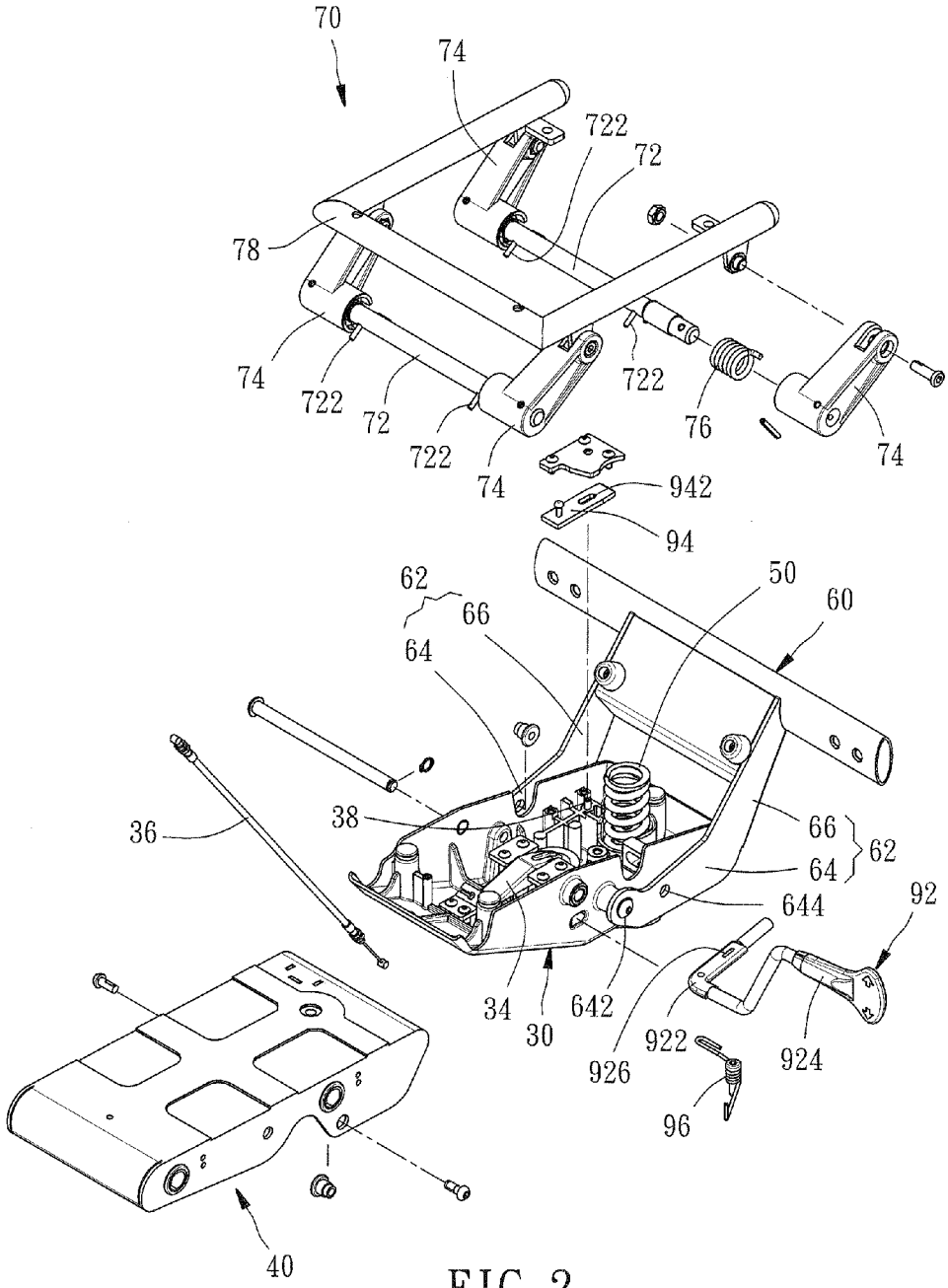
FIG. 2 is an exploded view of the chair adjustment structure in accordance with the present invention.
Figure 8:
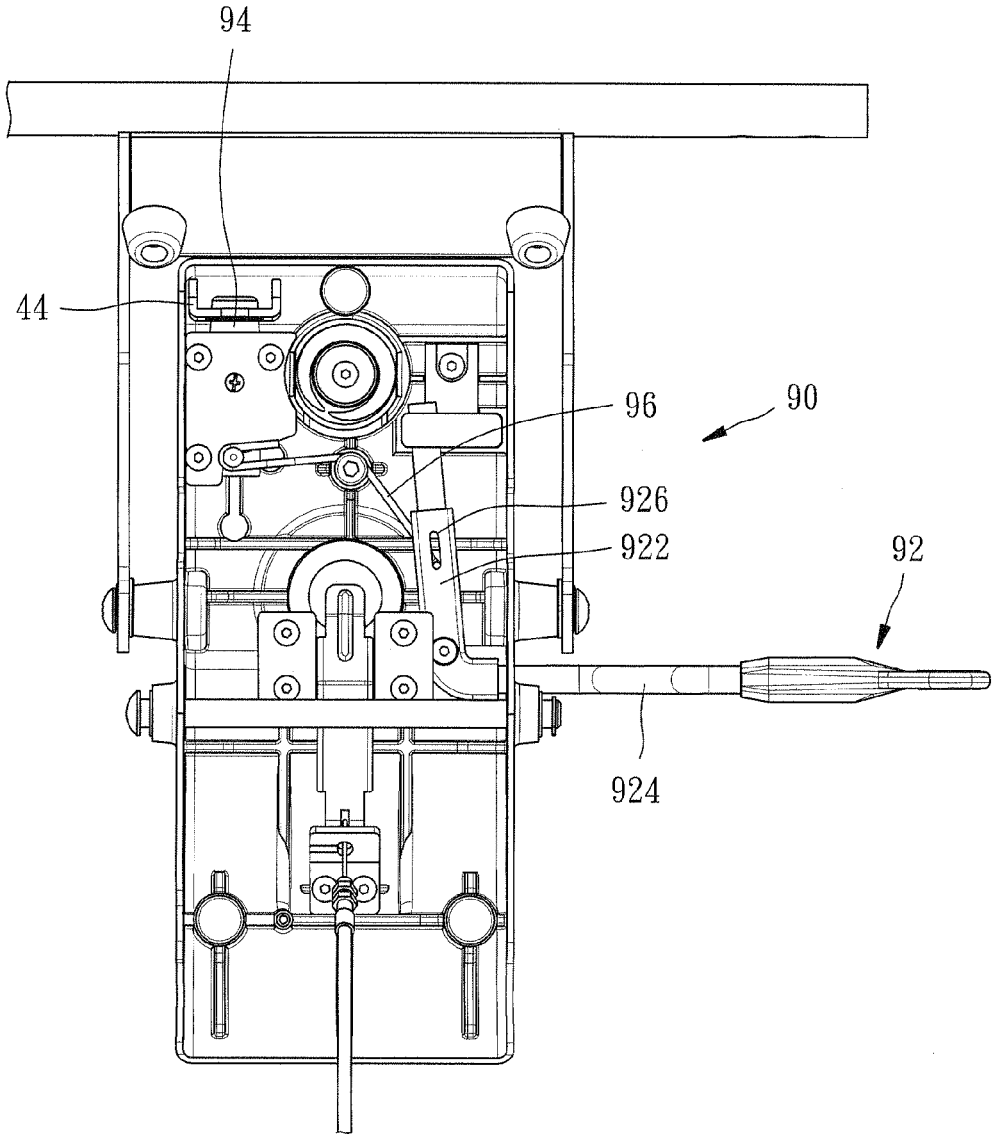
FIG. 8 is a top view of the present invention without the top cover and the seat frame assembly, showing that the locating plate is inserted into one locating groove of the positioning member.
Figure 9:
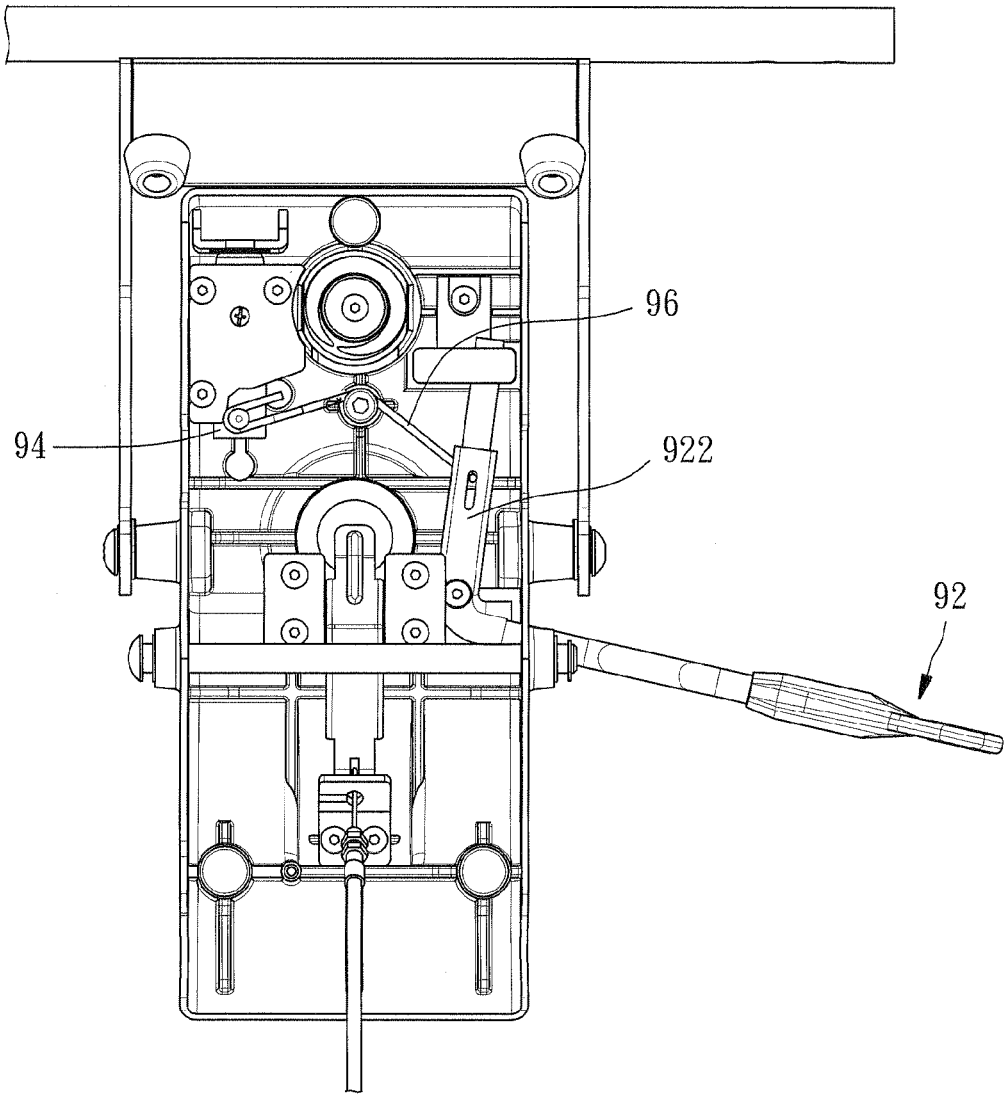
FIG. 9 is similar to FIG. 8, showing that the locating plate disengages from the positioning member.

The angle adjustment device set 90 comprises a control bar 92, a locating plate 94, and a linking member 96, as shown in FIG. 2 and FIG. 8. The control bar 92 comprises a linking segment 922 and a control segment 924. The linking segment 922 is pivotally connected to the base member 30, having an elongated slot 926. The control segment 924 extends outward from the linking segment 922 through the base member 30 for the user's operation. The locating plate 94 has an elongated slot 942 for a pin 38 of the base member 30 to pass through for enabling the locating plate 94 to move back and forth relative to the base member 30 and then to be selectively inserted into one of the locating grooves 442 of the positioning member 44 of the top cover 40, as shown in FIGS. 2, 4, and 8. In this embodiment, the linking member 96 is a torsion spring, having its one end inserted into the elongated slot 926 of the linking segment 922 of the control bar 92 and its other end connected to the locating plate 94 in such a way that the control bar 92 is operable to move the locating plate 94 forwards or backwards.

After the detailed recitation of the chair adjustment structure 20, the operation and features of the present invention are described hereinafter.

Figure 6:
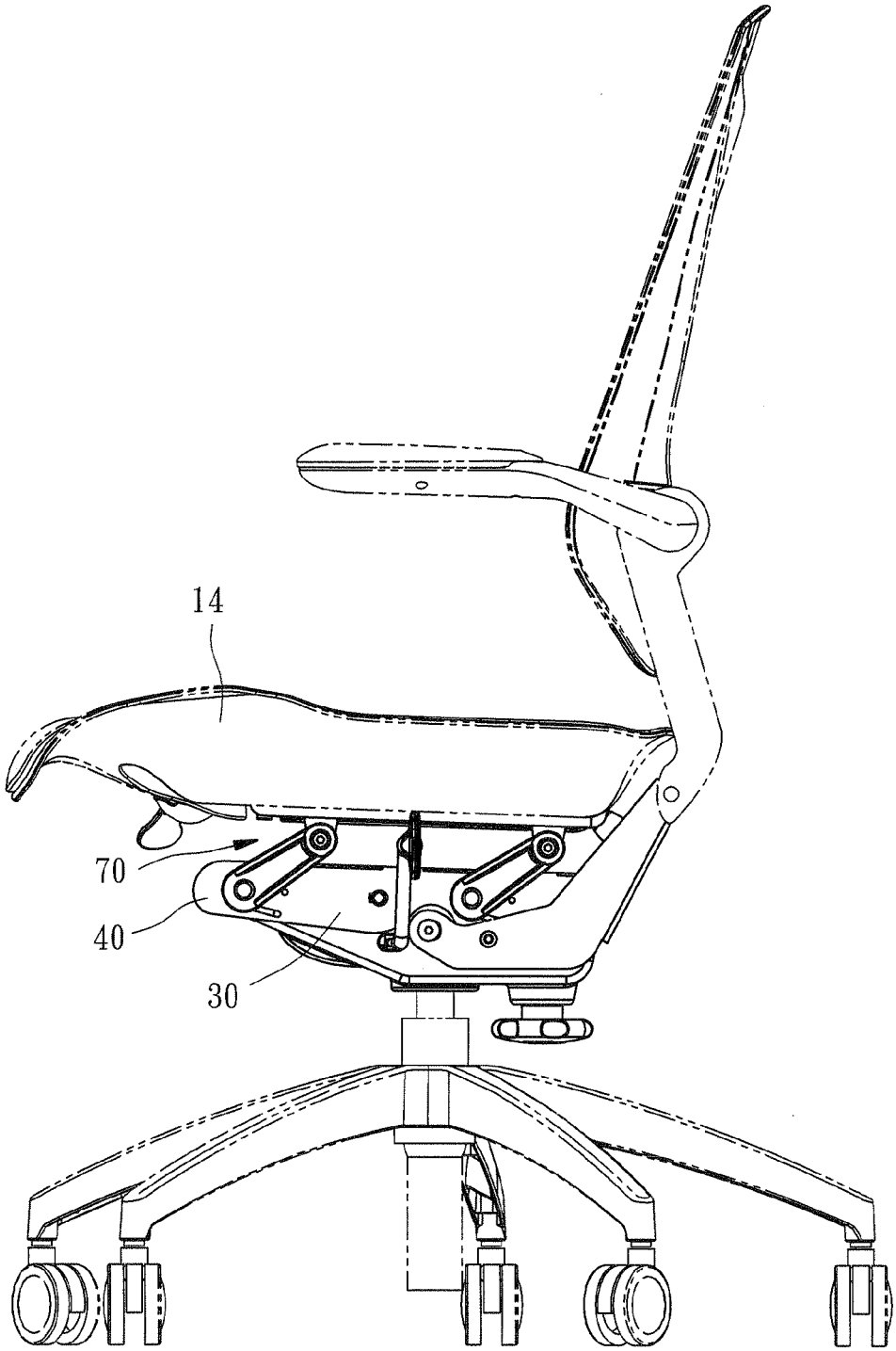
FIG. 6 is similar to FIG. 5, showing the seat frame assembly biased upon a downward force at the seat pad.
Figure 7:
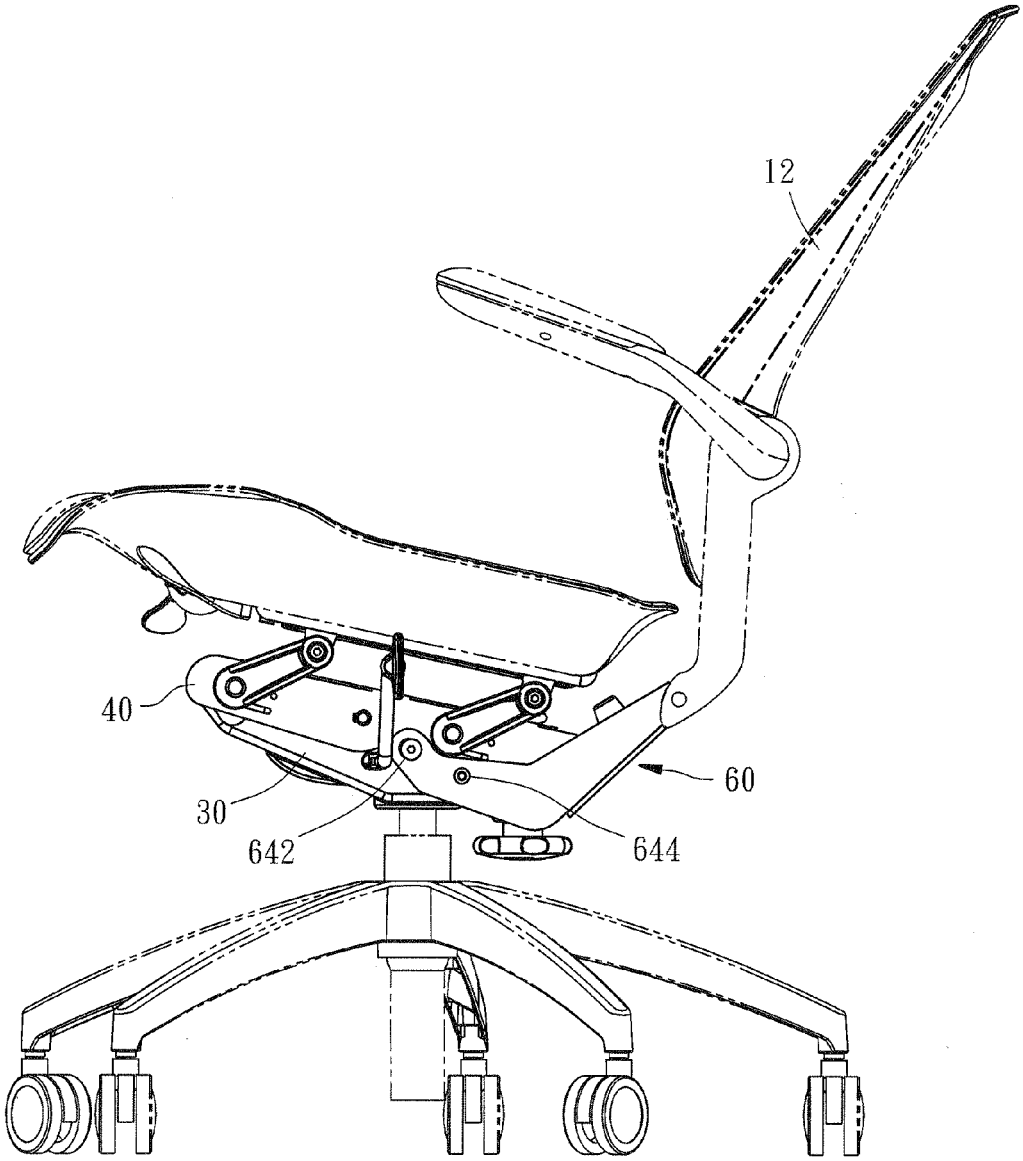
FIG. 7 is similar to FIG. 6, showing the angle of inclination of the back bracket and the top cover changed upon a force applied to the seat back.

Referring to FIG. 6, when the user sits on the seat pad 14, the seat frame assembly 70 is forced to pivot. During pivoting movement of the seat frame assembly 70, the top cover 40 is moved with the seat frame assembly 70 relative to the base member 30, and meanwhile, the user is biased with the seat pad 14 to rest his (her) back on the seat back 12 of the chair 10. Thus, when sitting on the seat pad 14, the user can touch the seat back 12 without moving the body. When the seat back 12 bears the user's weight, as shown in FIG. 7, the back bracket 60 will pivot on the first pivot portion 642 relative to the base member 30 to change its angle of inclination. At this time, due to the effect that the second pivot portion 644 is pivotally connected to the top cover 40, the top cover 40 is inclined slightly upwards without movement along with the back bracket 60 to the same angle of inclination. Therefore, the user will not suspend the feet in the air above the ground after having sat in position, i.e. the chair 10 can provide sitting comfort to the user. When the user is going to leave from the chair 10 and then applies a force to the ground through the feet, the seat frame 78 gives an upward force to the user's hips subject to the return force of the spring member 76 to help the user leave from the chair 10 with less effort.

In addition, when it is intended to adjust the angle of the top cover 40, as shown in FIGS. 2 and 4, the user can push the control bar 92 forwards to pivot the linking segment 922 of the control bar 92 toward the locating plate 94. At this time, the linking member 96 will be forced to move the locating plate 94 forwardly away from the locating grooves 442 of the positioning member 44 of the top cover 40, allowing the user to adjust the angle of inclination of the top cover 40 subject to his or her requirement and the spring force applied by the spring member 50 to the top cover 40. After adjustment of the angle of inclination of the top cover 40, the user can pull the control bar 92 backward, as shown in FIGS. 2, 4 and 8. At this time, the linking segment 922 of the control bar 92 will force the linking member 96 to move the locating plate 94 backwards to be inserted into one of the locating grooves 442 of the positioning member 44 of the top cover 40, thus locking the top cover 40 in the adjusted position.

Figure 10:
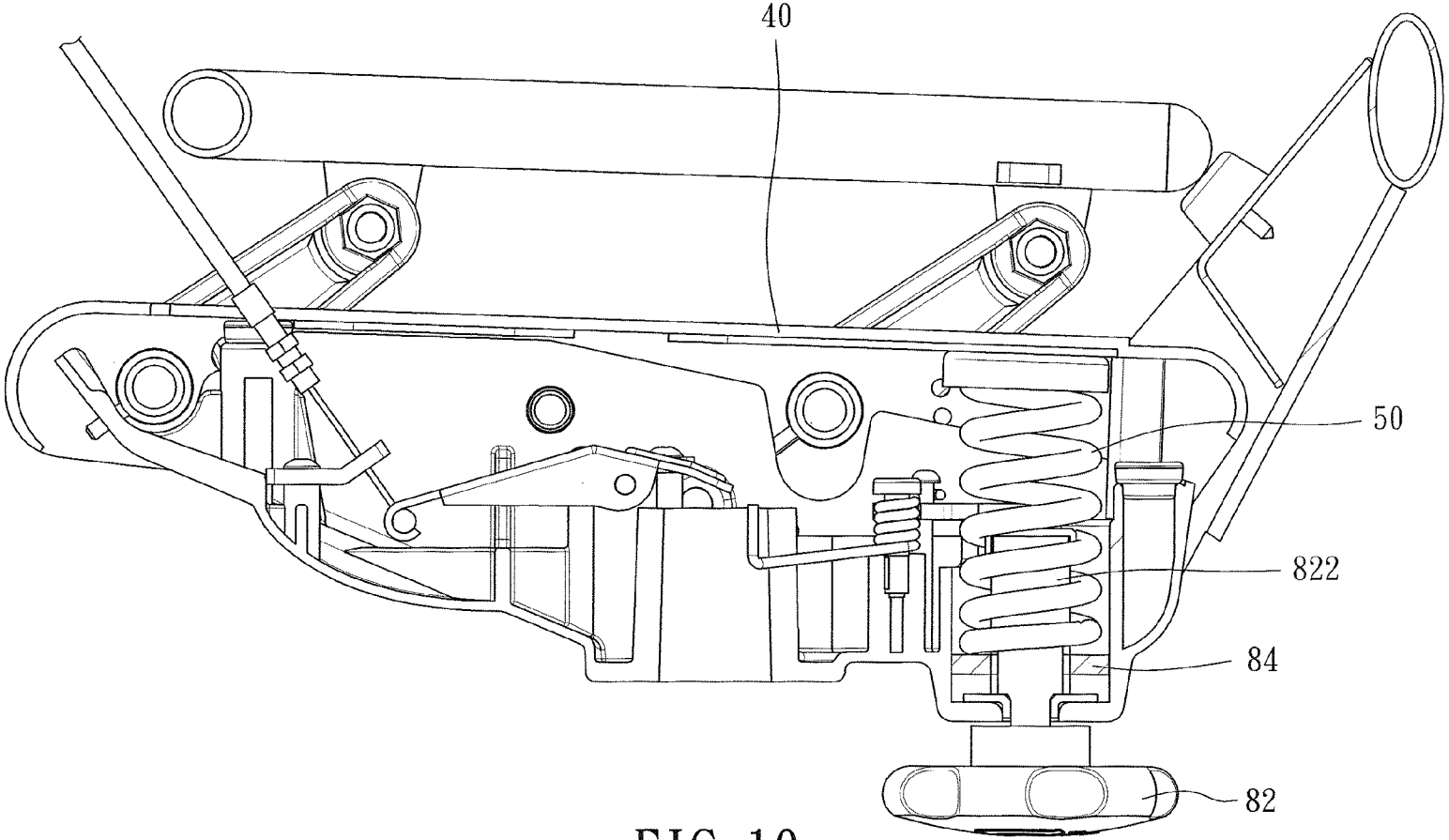
FIG. 10 is similar to FIG. 3, showing that the position of the screw nut of the spring force adjustment device set is adjusted and the spring member is compressed.

Further, when it is intended to change the spring force of the spring member 50 to the top cover 40, as shown in FIG. 10, the user can rotate the knob 82 to move the screw nut 84 upwardly along the screw rod 822 against the spring member 50, thus changing the return force of the spring member 50 to the top cover 40.

Furthermore, when it is intended to adjust the elevation of the chair 10, as shown in FIGS. 3 and 5, the user can pull the cord member 36 to pivot the actuating member 34 against the pneumatic lifter 16, thereby adjusting the elevation of the chair 10.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A chair adjustment structure comprising:

a base member;

a top cover disposed at a top side relative to said base member and having a middle part thereof pivotally connected to said base member;

a spring member mounted to said base member and having a top end stopped against said top cover;

a back bracket having two sidewalls, each of which has a first extension portion disposed at one lateral side of said base member, a second extension portion obliquely upwardly extending from said first extension portion, a first pivot portion located on one end of said first extension portion and pivotally connected to said base member, and a second pivot portion located on said first extension portion adjacent to said second extension portion and pivotally connected to said top cover;

a seat frame assembly, wherein said seat frame assembly comprises:

two axles respectively pivotally connected to said top cover;

four links each having a bottom end pivotally connected to one of two ends of one of said axles;

four torsion springs respectively mounted to one of two ends of each of two axles, each said torsion spring having two ends respectively stopped against said top cover and said links; and a seat frame pivotally connected to top ends of said links.

2. The chair adjustment structure as claimed in claim 1, wherein said top cover comprises two barrels for the axles to pass through respectively, each of said barrels having a notch located at least one of two ends thereof, each of said axles having a pin for contact with a sidewall of one of the notches while the axle pivots.

3. The chair adjustment structure as claimed in claim 1 further comprising an actuating member and a cord member, wherein said actuating member is pivotally connected to said base member and has an end projecting into a top end of a pneumatic lifter mounting hole formed at said base member, and the cord member has an end connected with said actuating member for pivoting said actuating member.

4. The chair adjustment structure as claimed in claim 1 further comprising a spring force adjustment device set, wherein said spring force adjustment device set has a knob and a screw nut, said knob being rotatably mounted in said base member and having a screw rod inserted through said spring member, said screw nut being threaded onto said screw rod of said knob and stopped against a bottom end of said spring member.

5. The chair adjustment structure as claimed in claim 1 further comprising an angle adjustment device set, wherein said angle adjustment device set comprises a control bar pivotally connected to said base member, a locating plate movably forwards and backwards mounted to said base member in a manner allowing forward and backward movement, and a linking member having two ends connected with said control bar and said locating plate respectively, said top cover having a plurality of locating grooves for inserting said locating plate selectively.

6. The chair adjustment structure as claimed in claim 5, wherein said linking member is a torsion spring having an end inserted into an elongated slot formed at said control bar and an opposite end thereof connected with said locating plate.

7. The chair adjustment structure as claimed in claim 5, wherein said locating plate comprises an elongated slot, and said base member comprises a pin inserted into the elongated slot of said locating plate.

* * * * *